US009809925B2

(12) United States Patent
Mora et al.

(10) Patent No.: US 9,809,925 B2
(45) Date of Patent: Nov. 7, 2017

(54) PARCHMENTIZED FIBROUS SUPPORT CONTAINING PARCHMENTIZABLE SYNTHETIC FIBERS AND METHOD OF MANUFACTURING THE SAME

(75) Inventors: Fernando Mora, Grenoble (FR); Hervé Planchard, Marcq en Baroeul (FR)

(73) Assignee: AHLSTROM-MUNKSJÖ OYJ, Helsinki (FI)

( * ) Notice: Subject to any disclaimer, the term of this patent is extended or adjusted under 35 U.S.C. 154(b) by 0 days.

(21) Appl. No.: 13/704,720

(22) PCT Filed: Jun. 13, 2011

(86) PCT No.: PCT/FI2011/050556

§ 371 (c)(1),
(2), (4) Date: Feb. 21, 2013

(87) PCT Pub. No.: WO2011/157892

PCT Pub. Date: Dec. 22, 2011

(65) Prior Publication Data

US 2013/0263385 A1 Oct. 10, 2013

(30) Foreign Application Priority Data

Jun. 15, 2010 (EP) ..... 10166077

(51) Int. Cl.

| | |
|---|---|
| ***D06M 17/00*** | (2006.01) |
| ***D06M 11/54*** | (2006.01) |
| ***D04H 3/08*** | (2006.01) |
| ***D21H 13/26*** | (2006.01) |
| ***D21H 11/20*** | (2006.01) |
| ***D21H 25/14*** | (2006.01) |
| ***D21H 27/08*** | (2006.01) |
| ***D21H 25/02*** | (2006.01) |
| ***D21H 27/06*** | (2006.01) |
| ***D04H 1/4209*** | (2012.01) |
| ***D04H 1/4342*** | (2012.01) |
| ***D04H 1/4382*** | (2012.01) |

(52) U.S. Cl.

CPC ..... *D06M 11/54* (2013.01); *D04H 1/4209* (2013.01); *D04H 1/4342* (2013.01); *D04H 1/4382* (2013.01); *D04H 3/08* (2013.01); *D21H 13/26* (2013.01); *D21H 11/20* (2013.01); *D21H 25/14* (2013.01); *D21H 27/08* (2013.01)

(58) Field of Classification Search

CPC ..... D06M 17/00; D06M 11/55; D06M 11/46; D06M 2101/06; D06M 2101/02; D06M 2101/40; D06M 2101/32; D06M 2101/34; D06M 2101/36; D06M 2200/00; D21H 5/08; D21H 5/18; D21H 5/1218; D21H 27/06; D21H 25/02; D21H 25/14; D21H 27/08; D21H 11/20; D21H 13/26; D04H 3/08; D04H 1/4209; D04H 1/4342; D04H 1/4382

USPC ..... 8/118, 115.68

See application file for complete search history.

(56) References Cited

U.S. PATENT DOCUMENTS

| | | | | |
|---|---|---|---|---|
| 5,137,768 | A * | 8/1992 | Lin | 428/116 |
| 5,393,601 | A | 2/1995 | Heinrich et al. | |
| 6,890,636 | B2 * | 5/2005 | Danver | 428/297.4 |
| 6,921,459 | B2 | 7/2005 | Kinsley et al. | |
| 2011/0057346 | A1 * | 3/2011 | Nunn | 264/103 |

FOREIGN PATENT DOCUMENTS

| | | | |
|---|---|---|---|
| CN | 101341289 | | 1/2009 |
| GB | 683218 | | 11/1952 |
| GB | 886994 | * | 1/1962 |
| JP | 57-61798 | | 4/1982 |
| JP | 60075700 | | 4/1985 |
| JP | 3-90693 | | 4/1991 |
| JP | 3090693 | * | 4/1991 |
| JP | 4-262317 | | 9/1992 |
| JP | 6-212593 | | 8/1994 |
| JP | 8006277 | | 1/1996 |
| JP | 2001-181951 | | 7/2001 |
| JP | 2002-317392 | | 10/2002 |
| WO | WO 92/14608 | | 9/1992 |
| WO | WO 99/49118 | | 9/1999 |
| WO | WO 2008/084139 | | 7/2008 |

OTHER PUBLICATIONS

International Preliminary Report on Patentability for PCT/FI2011/050556, dated Sep. 19, 2012.
International Search Report for PCT/FI2011/050556, dated Sep. 15, 2011.
Search Report for EP 10166077.7, dated Sep. 27, 2010.
CN Office Action dated Apr. 15, 2014.
JP Office Action dated Apr. 25, 2014.

* cited by examiner

*Primary Examiner* — Amina Khan
(74) *Attorney, Agent, or Firm* — Nixon & Vanderhye P.C.

(57) ABSTRACT

The present invention relates to a parchmentized fibrous support containing parchmentizable synthetic fibers parchmentized with sulfuric acid, the process for making such a support and the use thereof.

14 Claims, No Drawings

PARCHMENTIZED FIBROUS SUPPORT CONTAINING PARCHMENTIZABLE SYNTHETIC FIBERS AND METHOD OF MANUFACTURING THE SAME

This application is the U.S. national phase of International Application No. PCT/FI2011/050556 filed 13 Jun. 2011 which designated the U.S. and claims priority to EP Patent Application No. 10166077.7 filed 15 Jun. 2010, the entire contents of each of which are hereby incorporated by reference.

FIELD OF THE INVENTION

The invention relates to a parchmentized fibrous support containing parchmentizable synthetic fibers and the associated process for making such a support.

Potential applications for this invention include electrical insulation, composites, honeycombs, filtration devices, to name a few.

BACKGROUND OF THE INVENTION

Consolidation of non woven fibrous fabrics can be achieved by heating or by hot calendering said fabrics. Calendering a sheet at high temperature usually increases its strength and lowers its porosity while heating alone does not prove to be sufficient to attain the same physical properties. Nevertheless, the high porosity required for certain applications is still obtained by heating alone. The fabric exhibits enhanced properties if both temperature and pressure are applied.

Due to their properties, aramid fibers and aramid fibrids are commonly incorporated into fabrics in order to prepare strong, high temperature resistant supports that show good electrical insulation aptitude.

In U.S. Pat. No. 5,667,900, an aramid support with high surface smoothness is described. This paper is prepared by laminating layers containing meta-aramid fibrids and aramid flocks. The nature and properties of the aramid polymer comprised in this paper make it particularly suitable for being used as electrical insulation paper, or heat-resistant paper.

A laminate containing para-aramid fibers is taught in U.S. Pat. No. 6,558,512. This laminate exhibits high strength, reduced thickness, and light weight. This non woven fabric contains para-aramid fibers as well as a thermosetting resin.

The laminate disclosed in U.S. Pat. No. 5,948,543 essentially consists of a non woven fabric comprising para-aramid and meta-aramid fibers that are adhered to each other by a resin binder. Thermal binding between meta-aramid fibers, and between meta-aramid fibers and para-aramid fibers is further achieved by hot calendering.

Such papers are preferably entirely made of aramid fibers since the presence of inorganic fibers may lead to an increase in porosity while good electrical insulation certainly requires low porosity.

On the other hand, the paper used to make honeycombs can contain, beside aramid, cellulose, glass fibers or carbon fibers without negatively affecting its properties for this particular application.

In fact, the composition of a paper is directly related to the application it is intended for. For instance, the aramid based Nomex® is used for electrical insulation, it is manufactured by mixing poly(metaphenylene isophthalamide) (=meta-aramid polymers) flocks and fibrids and then subjecting the mixture to hot-press calendering.

Aramid fabrics are made of high temperature resistant fibers, usually aramid fibers and aramid fibrids. As already mentioned, they can be combined with other fibers such as cellulose.

These fabrics containing synthetic fibers such as aramid fibers are strengthened after being calendered. A resin binder is usually required; however, it does not allow to completely retain the original properties of the aramid fibers.

The Applicant has developed a consolidated support containing synthetic fibers. Its stiffness and strength are increased by more than 30% as compared to standard supports of the prior art. Moreover, the properties of the synthetic fibers are not altered during the manufacturing of this fibrous support.

SUMMARY OF THE INVENTION

The present invention is related to a support that exhibits improved stiffness, rigidity and strength as compared to similar prior art supports. Its porosity can also remain at a high level, as required for certain applications.

As used herein, the term "support" means "sheet", "fabric", "paper" or "web".

As used herein, the term "stiffness" means resistance to bending or ability for the support to support its own weight. On the other hand, the term "rigidity" relates to the property of resisting an applied bending force; it is proportional to Young's modulus.

The strength of the support is defined as the square root of its tear index multiplied by its burst index, the tear index being the force needed to continue tearing the support and the burst index being the pressure at which the support bursts.

The Applicant has discovered that parchmentizing a fibrous support allows to improve the stiffness, the rigidity and the strength of the support. Surprisingly, the Applicant has found out that some synthetic fibers can be parchmentizable.

More precisely, the present invention relates to a parchmentized fibrous support containing parchmentizable synthetic fibers.

In a preferred embodiment of the invention, the parchmentizable synthetic fibers are aramid based fibrous materials such as aramid fibers and/or aramid fibrids.

Preferably, the parchmentized fibrous support containing parchmentizable synthetic fibers of the invention is a non woven support. However, the invention also relates to woven supports.

A "non woven support" refers to a material manufactured from a random arrangement of individual fibers which are interlaid. They can be held together by adhesives, heat and pressure, or needling for example. Many processes for preparing such non woven supports are available to the skilled man; they include meltblowing, spin laying, carding, air laying and water laying processes. In the context of the present invention, the individual fibers are not held to each other by conventional binders (e.g. latex, poly vinyl alcohol, starch . . . ).

The non woven parchmentized fibrous support of the present invention is preferably prepared by mixing fibers and fibrids in an aqueous medium according to the so called wet laid process. The fibrous support can be produced on a mono or multi-layer wet laid machine.

Unless otherwise specified, the term "fiber" means a material form characterized by an extremely high ratio of length to diameter (e.g. 50/1). In the context of the present invention, the suitable fiber length is advantageously from about 0.3 cm, to about 4 cm.

As known in the art, the terms "short fibers" and "flock" or "flocs" have the same meaning and can be used interchangeably in reference to fibers of relatively short length.

As described in U.S. Pat. No. 2,999,788, the term "fibrids", as used herein, means very small, nongranular, fibrous or film-like particles with at least one of their three dimensions being of minor magnitude relative to the largest dimension. These particles are generally prepared by precipitation of a solution of polymeric material using a non-solvent under high shear.

As already mentioned, the present invention relates to a parchmentized fibrous support containing parchmentizable synthetic fibers.

Prior art vegetable parchments are cellulose based supports treated with a gelatinizing agent such as, for example, sulfuric acid. The reaction time between the gelatinizing agent and the cellulose is limited in order to control cellulose dissolution, hydrolysis and degradation. After treatment, the gelatinizing agent is washed off prior to drying the treated support.

During this treatment, the cellulose is partially dissolved or gelatinized. The dissolved cellulose precipitates when the gelatinizing agent is diluted, when it is being rinsed off. A very tough, stiff and smooth support results of the parchmentizing process.

Herein, a parchmentized fibrous support is preferably a support that has been treated in a sulfuric acid bath after its formation, even though the sulfuric acid treatment can also be accomplished by other means such as by spray, by using a coating device, a press device to name a few.

During the sulfurization process, plasticizing of the support is attained after swelling and/or partial dissolution of the fibers. However, it is important to monitor both the concentration in sulfuric acid and the duration of exposition to sulfuric acid in order to avoid the complete dissolution of the fibrous support.

Indeed, the skilled man in the art will adjust the sulfuric acid concentration accordingly to the support composition.

The parchmentizing process allows to modify the structure of the fibers without changing the chemical formula of the fibers.

As used herein, the term "synthetic fiber" means man-made material, for example glass, polymer, combination of polymers, metal, carbon . . . . Synthetic fibers may be parchmentizable or not.

In the context of the present invention, parchmentizing the fibrous support does not necessarily imply a chemical modification of all the different fibers comprised in the support. On the other hand, the external features of the support are definitely changed; after treatment, the support can present a glassy look commonly observed for parchmentized supports. Nevertheless, it is reasonable to assume that, at least, part of the fibers and/or fibrids reacted upon sulfurization.

In a preferred embodiment of the invention, the synthetic fibers can also be fibers that have been coated with a parchmentizable coating. In fact, during the sulfurization step, the core of the fibers does not have to be parchmentized while the coating forming the outer layer is parchmentized. The core may or may not be parchmentizable.

As already stated, the present invention relates to a parchmentized fibrous support containing parchmentizable synthetic fibers wherein the fibrous support is preferably a non woven support. It can be made of long and/or short fibers and/or fibrids. The fibrous support can contain more than one sort of synthetic fibers.

In a preferred embodiment of the invention, the parchmentized fibrous support can contain synthetic fibers that are particularly selected from the group comprising:

- aramid based fibrous materials such as aramid fibers and/or aramid fibrids;
- polyamide based fibrous materials;
- polyester based fibrous materials;
- organic based fibers such as carbon fibers;
- inorganic based fibers such as glass fibers;
- or a mixture thereof.

This list of synthetic fibers is not exhaustive; the skilled man will be able to select other suitable synthetic fibers.

By fibrous materials, we mean fibers or fibrids.

Preferably, synthetic fibers average from about 3 mm to about 40 mm in length.

Synthetic fibers can improve the strength of the fibrous support while still giving some porosity to the support.

The fibrous support can also contain non fibrous materials like inorganic non fibrous fillers (e.g. titanium dioxide, mica, talc, clay . . . ) and/or organic non fibrous fillers (e.g. polymethyl urea . . . ).

In a preferred embodiment, the synthetic fibers comprised in the parchmentized fibrous support are fibrids and fibers that may be of any aramid polymer. The aramid fibers and fibrids may be selected from the group containing: poly(m-phenylene isophthalamide), poly(p-phenylene terephthalamide), copolymers of the products mentioned formerly. One interesting embodiment would be use of bicomponent fibers having a parchmentizable outer layer and core or any material having sufficient strength.

The skilled man is able to select the appropriate aramid material and adjust the right mixture by weight in order to prepare a parchmentized fibrous support having precise properties. For instance, some aramid polymers are particularly suitable for improving fire protection, while other can improve the abrasion resistance.

Para-aramid fibrids or fibers are yellow and have a high Young's modulus. They provide outstanding strength-to-weight properties.

Meta-aramid fibers are white, they have a softening point of about 273° C.

As used herein, the term "aramid fibrids" means non-granular film-like particles of aromatic polyamide. Preferably, Aramid polymers have a decomposition point above 320° C. They have a high specific surface and give some strength to the support.

In a particular embodiment of the invention, the aramid based fibrous material can be an aramid pulp i.e. an aramid material having many fibrils, attached or not to fiber trunks. Fibrils are fine fibers while a trunk is a stem to which fibrils are attached.

When suitable, the fibers can also be mechanically treated in order to increase their fibrilar character.

The parchmentized fibrous support of the present invention can contain aramid based fibrous materials that can indistinctively be meta and/or para-aramid fibers and/or fibrids. For instance, the present invention can relate to a parchmentized fibrous support comprising both meta-aramid fibers and para-aramid fibrids.

When appropriate, other aramid materials can be considered for the purpose of the invention.

In the present invention, synthetic fibers represent from 20 to 100%, by weight of the parchmentized fibrous support, preferably from 80 to 100% and more preferably from 95 to 100%.

In a particular embodiment of the invention, the synthetic fibers weight percentage represents 100%, by weight of the parchmentized fibrous support i.e. it does not contain additional fibers such as natural fibers for example.

An even more particular support composition comprises only synthetic fibers that are aramid based fibrous materials, advantageously aramid fibers and/or aramid fibrids. As a result, the invention also relates to a one hundred percent aramid based parchmentized fibrous support.

The invention also relates to a parchmentized fibrous support entirely made of aramid fibers i.e. the aramid fibers represent 100% by weight of the parchmentized fibrous support. The parchmentized fibrous support can also be entirely made of aramid fibrids i.e. the aramid fibrids represent 100% by weight of the parchmentized fibrous support.

Advantageously, the weight percentage of aramid fibers can range from about 20 to about 100%, preferably about 30% to about 100% and most preferably about 50% to about 100%, by weight of the parchmentized fibrous support.

On the other hand, the weight percentage of aramid fibrids can range from about 20 to about 100%, preferably about 20% to about 100% and most preferably about 30% to about 100%, by weight of the parchmentized fibrous support.

The fibrous support may also contain natural fibers such as cellulose or regenerated cellulose.

The term "cellulose fiber" as used herein means a fiber comprised substantially of cellulose. Cellulose fibers come from manmade sources (for example, regenerated cellulose fibers like rayon fibers) or natural sources such as cellulose fibers or cellulose pulp from woody and non-woody plants. Woody plants include, for example, deciduous and coniferous trees. Non-woody plants include, for example, cotton, flax, esparto grass, kenaf, sisal, abaca, milkweed, straw, jute, hemp, and bagasse.

Cellulose fibers advantageous for use in parchmentizing include Eucalyptus, Birch, Red Cedar, abaca, Acacia, flax and linen.

They also include rejects from the textile industry

The term "cellulose pulp", as used herein, means cellulose fibers or fibrillated manmade fibers, which are refined or subjected to some other special treatment to be fibrillated.

Natural fibers can have diverse properties and structural characteristics since they do not exhibit the same shape, size, or thickness. Moreover, the polymerization degree of cellulose can differ significantly from one kind of cellulosic fibers to another one.

The parchmentized fibrous support of the present invention may contain:

aramid fibers;

aramid fibrids;

natural fibers; and organic and/or inorganic non fibrous fillers

In a preferred embodiment, the natural fibers represent from about 0 to about 80% by weight of the parchmentized fibrous support, preferably from about 0% to about 40%.

In a preferred embodiment, the organic and/or inorganic non fibrous fillers represent from about 0 to about 60% by weight of the parchmentized support, preferably from about 0 to about 30%.

In a preferred embodiment, the parchmentized fibrous support of the invention is calendered. This additional step allows to further improve the texture and properties of the fibrous support although stiff, rigid and high strength parchmentized fibrous support can be obtained without calendering.

By calendering, we mean a process for smoothing the surface of a nonwoven support by pressing it between opposing surfaces. The opposing surfaces include flat platens, rollers, rollers having projections and combinations thereof. Either or both of the opposing surfaces may be heated.

As known by the skilled man in the art, the parchmentized fibrous support may be calendered by super calendering or by hot calendering. The temperature at which the hot calendering step is achieved is from about 80° C. to about 350° C., preferably from about 180° C. to about 320° C.

The present invention also relates to a process of making a parchmentized fibrous support, said parchmentized fibrous support comprising parchmentizable synthetic fibers, according to the following steps of:

manufacturing a fibrous support;

parchmentizing said fibrous support by a treatment with $H_2SO_4$;

possibly calendering the parchmentized fibrous support.

Temperature, concentration of sulfuric acid and duration of the treatment are parameters that are adjusted accordingly with the composition of the fibrous support.

Preferably, the $H_2SO_4$ treatment of the fibrous support lasts from about 5 to about 60 seconds.

Advantageously, the $H_2SO_4$ concentration can be from about 50% to about 100%.

Preferably, the $H_2SO_4$ is at a temperature of from about −20° C. to about +50° C.

In a particular embodiment of the present invention, the fibrous support is manufactured by hydroentanglement of the synthetic fibers and the natural fibers when suitable.

As opposed to other suitable bonding processes for non woven supports, lightweight supports reflecting exactly the characteristics of the fibers can be obtained by hydroentanglement. Indeed, thermal bonding welds the fibers together which prevents any interfiber movement while latex bonding covers the fibers with a polymeric film.

In a particular embodiment of the present invention, the process of making a parchmentized fibrous support is characterized in that the parchmentized fibrous support comprises at least two fibrous supports that have been parchmentized together.

In a particular embodiment of the present invention, the process of making a parchmentized fibrous support is characterized in that the parchmentized fibrous support comprises at least two fibrous supports that have been previously parchmentized separately and further parchmentized together.

In an even more particular embodiment of the present invention, the parchmentized fibrous support can comprise at least one fibrous support that has been previously parchmentized and at least one fibrous support that has not been previously parchmentized. These previously parchmentized and non previously parchmentized fibrous supports are then parchmentized together.

The present invention also relates to the use of a parchmentized fibrous support containing parchmentizable synthetic fibers for making electrical insulators, composites, honeycombs, filtration devices such as hot gas filters.

EXAMPLES—DETAILED DESCRIPTION OF EMBODIMENTS OF THE INVENTION

The invention and its advantages will become more apparent to one skilled in the art from the following examples.

In the following examples, the temperature of parchmentizing is 20° C.

Example 1

A support containing 40% of meta-aramid fibrids and 60% of meta-aramid fibers (6 mm, 2 dTex) was made on an inclined wire pilot machine. One part of the support was then parchmentized during different durations and at different sulfuric acid concentrations.

The characteristics of the supports were as follows (the strength is defined as the square root of the burst index multiplied by tear index of the support):

Acid concentration=72%

Standard (non parchmentized): Strength=4.68 N·m/g (Tear index=14.6 mN·m$^2$/g and burst index=1.5 kPa·m$^2$/g)

Sample 1 (parchmentized during 10 s): Strength=6.3 N·m/g

Sample 2 (parchmentized during 20 s): Strength=6.9 N·m/g

Acid concentration=85%

Standard (non parchmentized): Strength=4.68 N·m/g

Sample 3 (parchmentized during 10 s): Strength=16.27 N·m/g

Sample 4 (parchmentized during 20 s): Strength=15.45 N·m/g

This example clearly shows that parchmentizing increases dramatically the strength of the meta-aramid supports. The optimization of the physical characteristics will be obtained by adjusting the sulfuric acid concentration and by varying the reaction time of the parchmentizing.

Example 2

A support containing 40% of para-aramid fibrids and 60% of para-aramid fibers (6 mm, 2 dTex) was made on an inclined wire pilot machine. One part of the support was then parchmentized at different sulfuric acid concentrations.

The characteristics of the supports were as follows (the strength is defined as the square root of the burst index multiplied by tear index of the support):

Acid concentration=85%

Standard (non parchmentized): Strength=5.18 N·m/g

Sample (parchmentized during 20 s): Strength=6.38 N·m/g

Acid concentration=90%

Standard (non parchmentized): Strength=5.18 N·m/g

Sample (parchmentized during 20 s): Strength=16.1 N·m/g

Para-aramid supports need an acid treatment at higher concentration than meta-aramid ones to achieve high strength characteristics Example 3

A support containing 40% of meta-aramid fibrids and 60% of meta-aramid fibers (6 mm, 2 dTex) was made on an inclined wire pilot machine. The support was then consolidated according to the previous art (heated at 280° C. or calendared at high temperature: pressure=280 N/mm and temperature=300° C.). One part of the non-consolidated support was parchmentized (sulfuric acid concentration=85%, time=20 s) on a pilot parchmentizer and the characteristics of the support obtained with this process were compared to those obtained with the previous art (see table 1)

TABLE 1

| For a 64 gsm support | Tensile km | Wet Tensile km | Tear index mN · m$^2$/g | Burst Index kPa · m$^2$/g | Strength N · m/g | Bendtsen porosity ml/min | Rigidity mN | Cobb 60 g/m$^2$ |
|---|---|---|---|---|---|---|---|---|
| Meta -aramid raw support | 0.9 | 0.3 | 14.6 | 1.5 | 4.68 | 1700 | 130 | 260 |
| Meta-aramid support heated | 2.9 | 1.1 | 32.6 | 2.4 | 8.85 | 2500 | 230 | 70 |
| Meta-aramid support heated + calendered | 4.7 | 3.3 | 23.9 | 7 | 12.93 | 40 | 80 | 27 |
| Meta-aramid raw support parchmentized | 3.1 | 2.6 | 44.7 | 5.8 | 16.10 | 1600 | 315 | 180 |

By parchmentizing meta-aramid supports it is possible to reach high physical characteristics and stiffnesses for the end products while keeping a high porosity and an excellent wettability (see the Cobb values)

Example 4

A support containing 40% of para-aramid fibrids and 60% of para-aramid fibers (6 mm, 2 dTex) was made on an inclined wire pilot machine. The support was then consolidated according to the previous art (calendered at high temperature: pressure=280 N/mm and temperature=300° C.). One part of the non-consolidated support was parchmentized (sulfuric acid concentration=90%, time=10 s) on a pilot parchmentizer and the characteristics of the support obtained after the process were compared to those of the previous art (see table 2). Table 2 shows that the parchmentizing process increases the strength of the para-aramid supports while keeping a high porosity that were not achievable by using the previous art (hot calendering)

TABLE 2

| For a 62 gsm support | Tensile km | Tear index mN · m$^2$/g | Burst Index kPa · m$^2$/g | Strength N · m/g | Bendtsen porosity ml/min |
|---|---|---|---|---|---|
| Para-aramid raw support (fibers/fibrids = 60/40) | 3.4 | 15.8 | 1.7 | 5.18 | 2700 |
| Para-aramid support (fibers/fibrids = | 4.3 | 21.2 | 2.6 | 7.42 | 45 |

TABLE 2-continued

| For a 62 gsm support | Tensile km | Tear index mN · m²/g | Burst Index kPa · m²/g | Strength N · m/g | Bendtsen porosity ml/min |
|---|---|---|---|---|---|
| 60/40) heated + calendered = previous art | | | | | |
| Para-aramid raw support (fibers/fibrids = 60/40) parchmentized | 10.3 | 31.3 | 8.4 | 16.1 | 2200 |

Example 5

A support containing 25% of para-aramid fibrids, 25% of para-aramid fibers (6 mm, 2 dTex) and 50% of glass fibers (6 mm, 2.2 dTex) was made on an inclined wire pilot machine. One part of the non-consolidated support was parchmentized (sulfuric acid concentration=90%, time=10 s) and the characteristics of the support obtained after the process were compared to those of the non consolidated support (see table 3)

TABLE 3

| For a 57 gsm support | Tensile km | Tear index mN · m²/g | Burst Index kPa · m²/g | Strength N · m/g | Bendtsen porosity ml/min |
|---|---|---|---|---|---|
| Para-aramid/ glass raw support (fibers/fibrids/ glass = 25/25/50) | 1.2 | 6.7 | 0.8 | 2.4 | 7800 |
| Para-aramid/ glass raw support (fibers/fibrids/ glass = 25/25/50) parchmentized | 3.4 | 13.2 | 2.7 | 6.0 | 8800 |

Parchmentizing allows to produce supports containing glass fibers and presenting high physical characteristics combined with high porosities.

Example 6

Two types of aramid supports were produced on an inclined wire machine:

Support 1 is made of 40% of para-aramid fibrids and 60% para-aramid fibers (6 mm, 2 dTex)

Support 2 is a 90% para-aramid fibrids/10% para-aramid fibers (6 mm, 2 dTex) support a multilayer structure comprising one support 2 between two supports 1 is parchmentized at a sulfuric acid concentration of 90% and a duration of 30 seconds. The resulting product shows a high cohesion between the 3 layers and can be used as if it was a mono layer one.

Example 7

A para aramid support was produced, as already described (see example 4) on an inclined wire machine. Before being dried, this support was hydroentangled by using water jets at high pressure. One part of the support was then parchmentized (sulfuric acid concentration=90%, time=10 s): the parchmentized hydroentangled support presents a stiffness that is the double of the one measured on the aramid support that was only hydroentangled.

The invention claimed is:

1. A process of making a parchmentized fibrous support comprising the steps of:

(a) forming a fibrous support comprised of parchmentizable synthetic aramid fibers and parchmentizable synthetic aramid fibrids; and (b) parchmentizing the parchmentizable synthetic aramid fibers and fibrids of the fibrous support by treating the fibrous support with $H_2SO_4$ at a concentration from about 50% to about 100% and at a temperature from about −20° C. to about +50° C. for between about 5 to about 60 seconds sufficient to obtain a parchmentized fibrous support having an increased strength of at least 30% as compared to the strength of the fibrous support formed according to step (a).

2. The process of claim 1, wherein step (a) is practiced by hydroentangling the parchmentizable synthetic aramid fibers and parchmentizable synthetic aramid fibrids to form the fibrous support.

3. The process of claim 1, comprising forming two fibrous supports and thereafter together parchmentizing the two fibrous supports.

4. The process of claim 1, wherein step (b) is practiced by treating the fibrous support with $H_2SO_4$ at a concentration of from 72% to 90% for between about 10 to about 20 seconds.

5. The process of claim 4, wherein the fibrous support comprises about 60 wt. % of the parchmentizable synthetic aramid fibers and about 40 wt. % of the parchmentizable synthetic aramid fibrids.

6. The process of claim 1, wherein step (a) comprises including in the fibrous support synthetic fibers selected from the group consisting of polyamide-based fibrous materials; polyester-based fibrous materials; carbon fibers; glass fibers; and mixtures thereof.

7. The process of claim 1, wherein step (a) comprises including natural fibers in the fibrous support.

8. The process of claim 7, wherein the natural fibers comprise cellulose fibers.

9. The process of claim 8, wherein the cellulose fibers comprise regenerated cellulose fibers.

10. The process of claim 1, wherein step (a) comprises including in the fibrous support at least one non-fibrous material selected from the group consisting of titanium dioxide, mica, talc, clay, and organic non-fibrous fillers.

11. The process of claim 1, wherein the parchmentizable synthetic aramid fibers and the parchmentizable aramid fibrids comprise 100 wt. % of the fibrous support formed according to step (a).

12. The process of claim 1, which further comprises the step of:

(e) calendering the parchmentized fibrous support.

13. The process of claim 12, wherein step (e) comprises calendering the parchmentized fibrous support at a temperature from about 80° C. to about 350° C.

14. The process of claim 13, wherein parchmentized fibrous support is calendered at a temperature from about 120° C. to about 320° C.

* * * * *